US008052436B1

(12) United States Patent
Ju

(10) Patent No.: US 8,052,436 B1
(45) Date of Patent: Nov. 8, 2011

(54) ELECTRICAL CONNECTOR WITH STABLE RETAINING TERMINALS

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/022,790

(22) Filed: Feb. 8, 2011

(30) Foreign Application Priority Data

Oct. 22, 2010 (CN) ..... 2010 2 0579427 U

(51) Int. Cl.
*H01R 12/00* (2006.01)

(52) U.S. Cl. ..... 439/83; 439/342

(58) Field of Classification Search ..... 439/342, 439/83, 857
See application file for complete search history.

(56) References Cited

U.S. PATENT DOCUMENTS 6,702,594 B2 * 3/2004 Lee et al. ..... 439/83
7,682,165 B2 * 3/2010 Liao ..... 439/83

* cited by examiner

*Primary Examiner* — Tho D Ta
(74) *Attorney, Agent, or Firm* — Morris Manning Martin LLP; Tim Tingkang Xia, Esq.

(57) ABSTRACT

An electrical connector includes an insulating body, having a plurality of receiving slots running through the insulating body; a plurality of terminals respectively received in the receiving slots; and a plurality of solder balls, in which each of the solder balls is disposed corresponding to each terminal and each receiving slot. Each terminal includes a base, a first retaining portion formed by extending downwards the base, a second retaining portion and a third retaining portion formed by bending and extending two side surfaces of the first retaining portion, and a groove formed at one end of the first retaining portion away from the base.

8 Claims, 6 Drawing Sheets

ELECTRICAL CONNECTOR WITH STABLE RETAINING TERMINALS

CROSS-REFERENCE TO RELATED PATENT APPLICATION

This non-provisional application claims benefits and priority under 35 U.S.C. §119(a) on Chinese Patent Application No. 201020579427.9 filed in The People's Republic of China on Oct. 22, 2010, which is incorporated herein by reference in its entirety.

FIELD OF THE INVENTION

The present invention relates to an electrical connector, and more particularly to an electrical connector for electrically connecting a chip module to a circuit board.

BACKGROUND OF THE INVENTION

FIG. 1 shows an electrical connector currently widely used in the field for electrically connecting a chip module to a circuit board. The electrical connector includes an insulating body 1, where a plurality of receiving slots 11 runs through the insulating body 1, a plurality of terminals 2, in which each of the terminals 2 is correspondingly disposed in one of the receiving slots 11, and a plurality of solder balls 3, respectively disposed in one of the receiving slots 11 and correspondingly contacting one of the terminals 2. Each of the terminals 2 includes a base 21, a first retaining portion 22 formed by extending downwards the base 21, a second retaining portion 23 and a third retaining portion 24 formed by bending and extending two side surfaces of the first retaining portion 22, and a retaining space 25 formed together by the first retaining portion 22, the second retaining portion 23, and the third retaining portion 24. The second retaining portion 23 and the third retaining portion 24 are distributed in symmetry to the first retaining portion 22, the solder ball 3 is received in the retaining space 25, and both the second retaining portion 23 and the third retaining portion 24 contact the solder ball 3.

However, the terminal 2 has some defects in the structure thereof which result in several problems mainly as follows.

First, the second retaining portion 23 and the third retaining portion 24 apply retaining forces to the solder ball 3, and the retaining forces generate arms of the retaining forces of the second retaining portion 23 and the third retaining portion 24 to retain the solder ball 3. However, limited lengths of the second retaining portion 23 and the third retaining portion 24 result in undesirable lengths of the arms of the retaining forces of the second retaining portion 23 and the third retaining portion 24 to retain the solder ball 3, thus causing great strength and limited elasticity of the second retaining portion 23 and the third retaining portion 24, so that at the time of inserting the solder ball 3, a large pressure is required to insert the solder ball 3.

Second, during the soldering, surface tension of the solder ball 3 is reduced and the surface thereof is deformed, but the second retaining portion 23 and the third retaining portion 24 do not have enough elasticity to effectively retract and extrude the solder ball 3, thereby resulting in unreliable soldering, such as missing soldering or poor soldering.

Therefore, a heretofore unaddressed need exists in the art to address the aforementioned deficiencies and inadequacies.

SUMMARY OF THE INVENTION

In one aspect, the present invention provides an electrical connector for easy insertion of a solder ball and reliable soldering.

In one embodiment, the present invention has the following inventive measures and provides an electrical connector that includes: an insulating body, where a plurality of receiving slots runs through the insulating body, a plurality of terminals, in which each of the terminals is correspondingly disposed in one of the receiving slots and each of the terminals has a base, a first retaining portion formed by extending downwards the base, a second retaining portion and a third retaining portion formed by respectively extending and bending two side surfaces of the first retaining portion, a groove formed at one end of the first retaining portion away from the base, in which a highest point of the groove is higher than a lowest point at junctions of the first retaining portion with the second retaining portion or the third retaining portion, and a retaining space formed together by the first retaining portion, the second retaining portion, and the third retaining portion; and a plurality of solder balls, in which each of the solder balls is correspondingly disposed in one of the retaining spaces and abuts against the second retaining portion and the third retaining portion.

Compared with the prior art, among other things, the electrical connector of the present invention is configured such that a groove is formed on the first retaining portion, the lengths of the arms of the retaining forces of the second retaining portion and the third retaining portion to retain the solder ball are extended without changing the lengths of the second retaining portion and the third retaining portion, thereby improving the elasticity of the second retaining portion and the third retaining portion, so that the insertion of the solder ball becomes easier and the soldering becomes more reliable.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The drawings described below are for illustration purpose only. The drawings are not intended to limit the scope of the present teachings in any way.

DETAILED DESCRIPTION OF THE INVENTION

Figure 1:
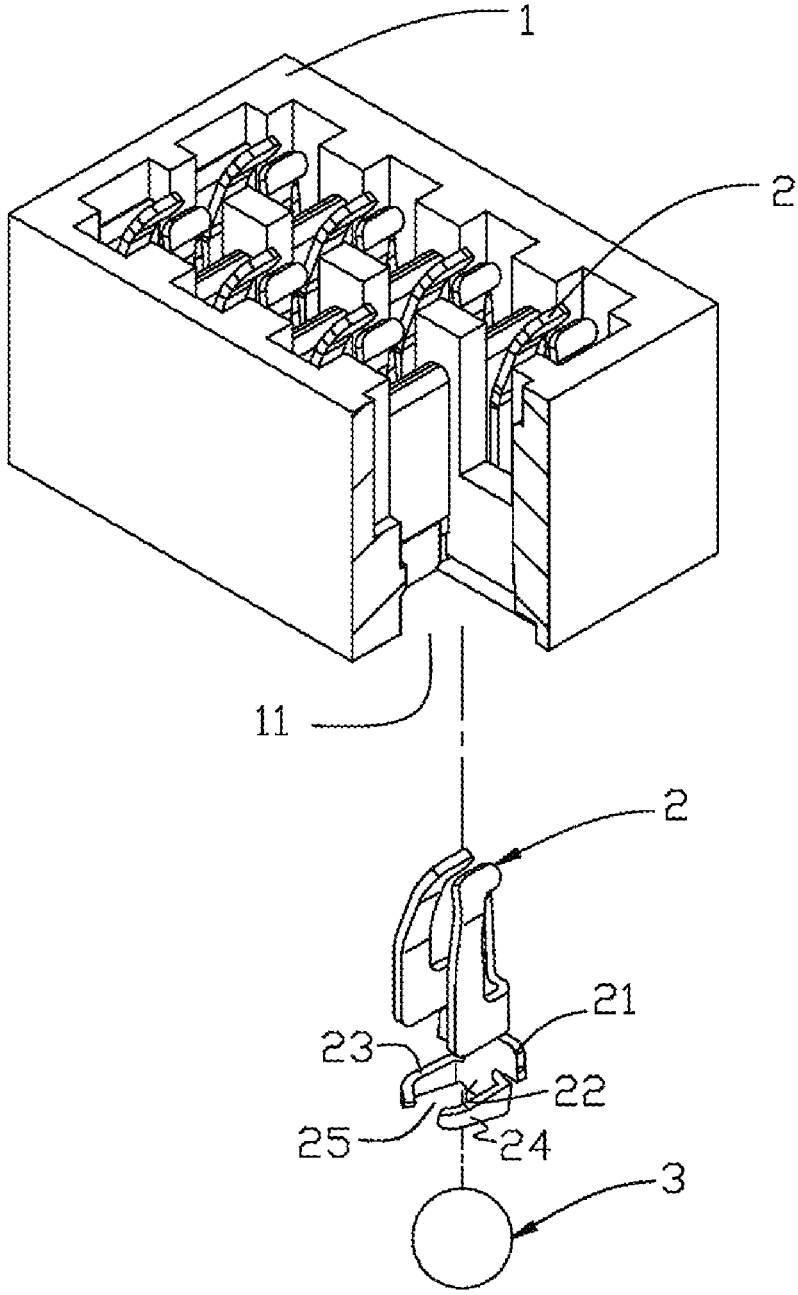
FIG. 1 (Related Art)
FIG. 1 is a three-dimensional exploded view of an electrical connector in the related art.

The present invention is more particularly described in the following examples that are intended as illustrative only since numerous modifications and variations therein will be apparent to those skilled in the art. Various embodiments of the invention are now described in detail. Referring to the drawings, FIGS. 2-6, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprising," "including," "having," "containing," "involving," and the like are to be understood to be open-ended, i.e., to mean including but not limited to.

A list of reference numerals with corresponding components as shown in the drawings is given below only for the purpose of a reader's convenience:

List of reference numerals in FIG. 1:

| | | |
|---|---|---|
| Insulating body 1 | Receiving slot 11 | Terminal 2 |
| Base 21 | First retaining portion 22 | Second retaining portion 23 |
| Third retaining portion 24 | Retaining space 25 | Solder ball 3 |

List of reference numerals in the electrical connector according to one or more embodiments of the present invention, FIGS. 2-6:

| | | |
|---|---|---|
| Insulating body 1 | Receiving slot 11 | Terminal 2 |
| Base 21 | First retaining portion 22 | Groove 221 |
| Second retaining portion 23 | Third retaining portion 24 | Retaining space 25 |
| Solder ball 3 | | |

Figure 2:
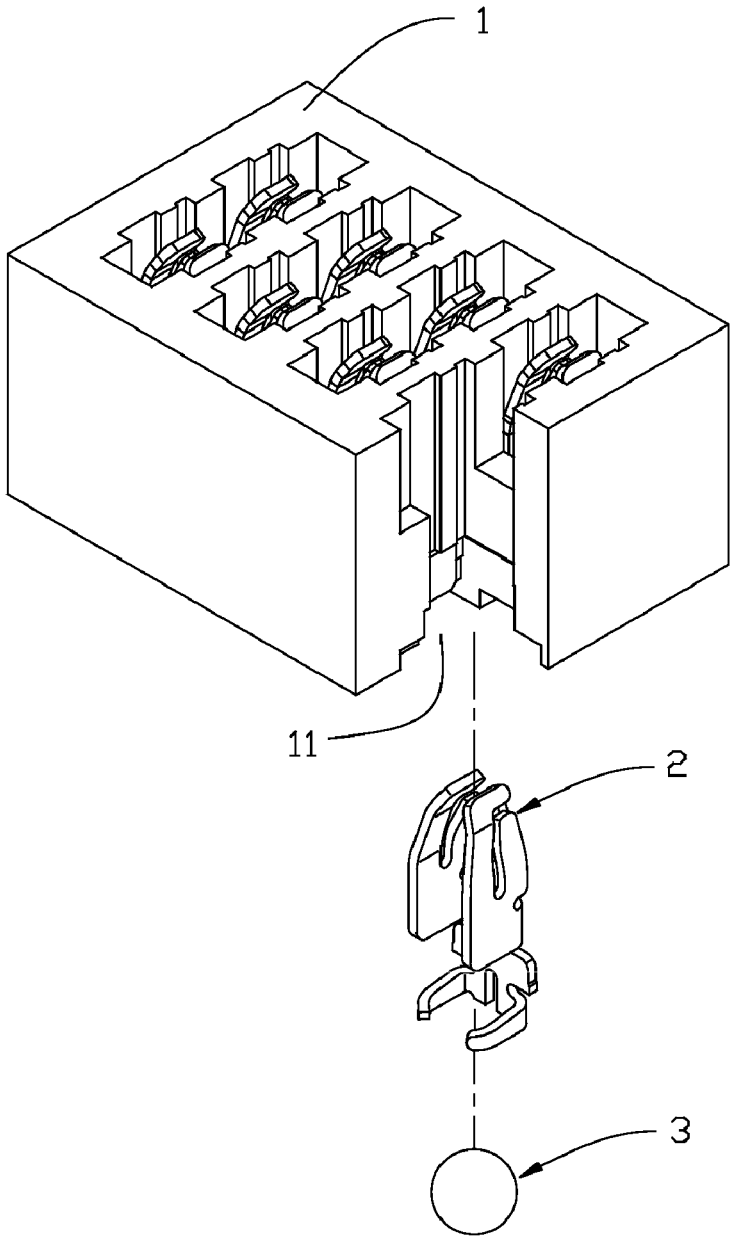
FIG. 2 is a three-dimensional exploded view of an electrical connector according to one embodiment of the present invention.

Referring to FIG. 2, the electrical connector according to one embodiment of the present invention includes an insulating body 1, a plurality of terminals 2 respectively received in the insulating body 1, and a plurality of solder balls 3 respectively disposed corresponding to the insulating body 1 and the terminals 2.

Referring to FIG. 2, the insulating body 1 has a plurality of receiving slots 11 running through the insulating body 1.

Figure 3:
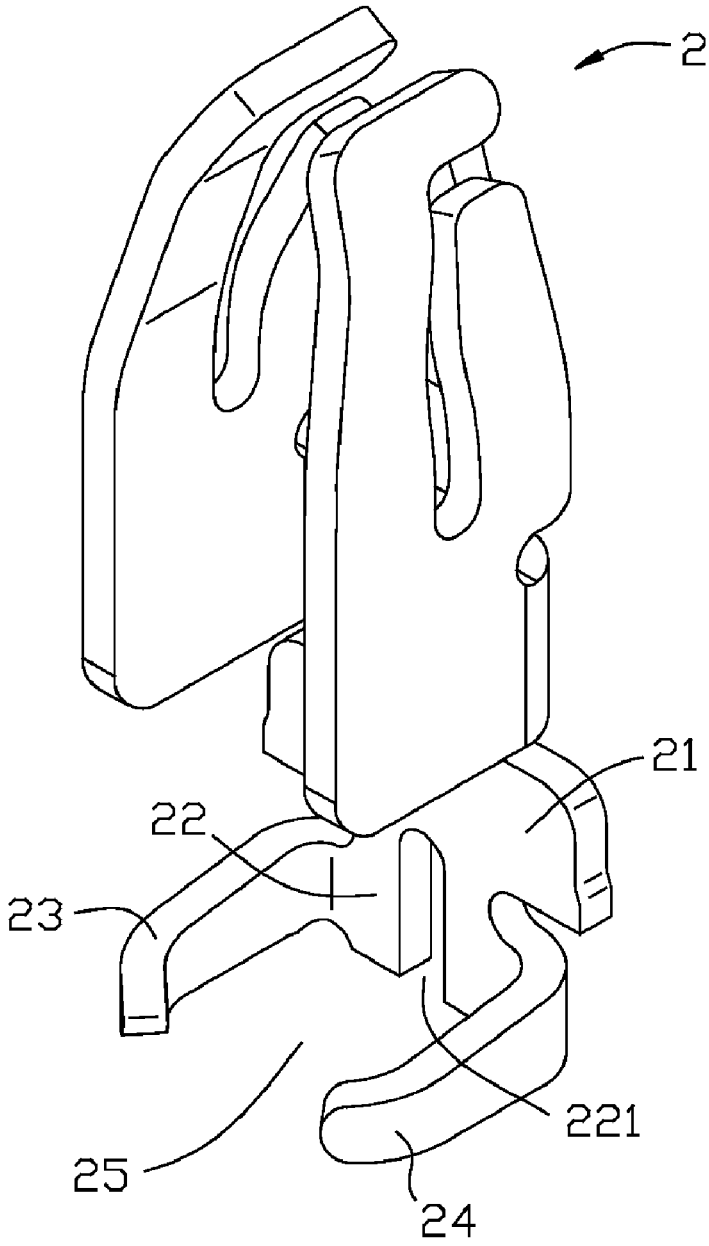
FIG. 3 is a three-dimensional view of a terminal in the electrical connector according to one embodiment of the present invention.

Referring to FIGS. 2 and 3, the terminals 2 are respectively disposed in the receiving slots 11 correspondingly. Each of the terminals 2 has a base 21, a first retaining portion 22 formed by extending downwards the base 21, in which the first retaining portion 22 has a coplanar surface with the base 21, a second retaining portion 23 and a third retaining portion 24 formed by respectively extending and bending two side surfaces of the first retaining portion 22, a groove 221 formed at one end of the first retaining portion 22 away from the base 21, in which a highest point of the groove 221 is higher than a lowest point at junctions of the first retaining portion 22 with the second retaining portion 23 or the third retaining portion 24, and a retaining space 25 formed together by the first retaining portion 22, the second retaining portion 23, and the third retaining portion 24.

Referring to FIGS. 2 and 3, each of the terminals 2 is tightly fixed and retained in one of the receiving slots through proper engagement, such as a interference fit, between the base 21 and the receiving slot.

Figure 4:
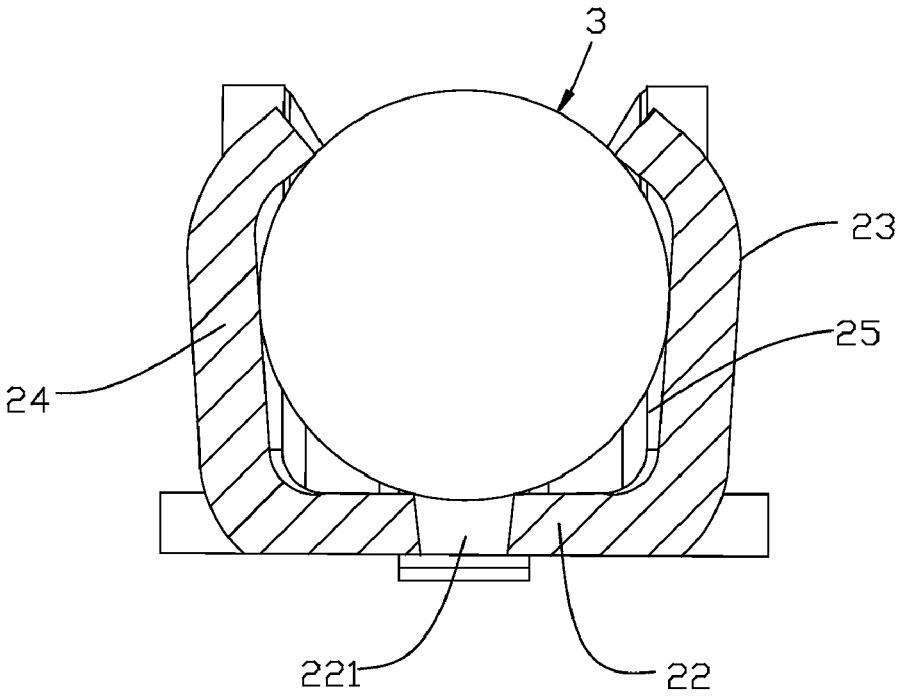
FIG. 4 is a sectional view showing that the terminal retains a solder ball in the electrical connector according to one embodiment of the present invention.

Referring to FIG. 4, free ends of the second retaining portion 23 and the third retaining portion 24 extend towards opposite directions and opposing surfaces thereof are curved surfaces. Each of the solder balls 3 is correspondingly disposed in one of the retaining spaces 25, abuts against the first retaining portion 22, the second retaining portion 23, and the third retaining portion 24, and has two contact points with the groove 221. When the solder ball 3 is inserted into the retaining space 25, the second retaining portion 23 and the third retaining portion 24 are extended outwards and deformed, and the groove 221 is also deformed.

Figure 5:
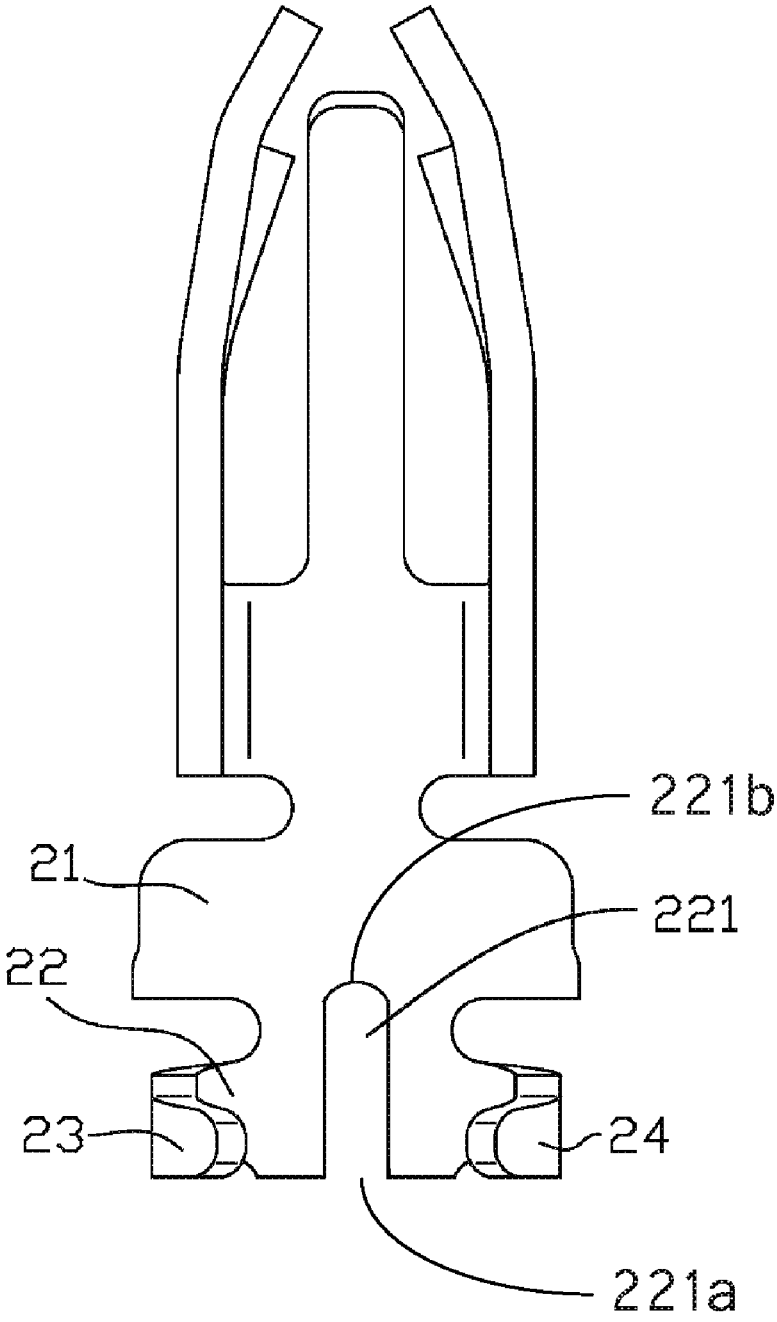
FIG. 5 is a front view of the terminal in the electrical connector according to one embodiment of the present invention.

Referring to FIG. 5, the groove 221 is formed vertically running through the first retaining portion 22 from back to front and is in an inverted U shape, in which one end 221*a* of the groove 221 away from the base 21 is in an opening configuration, and the highest point 221*b* of the groove 221 is located on the base 21.

Figure 6:
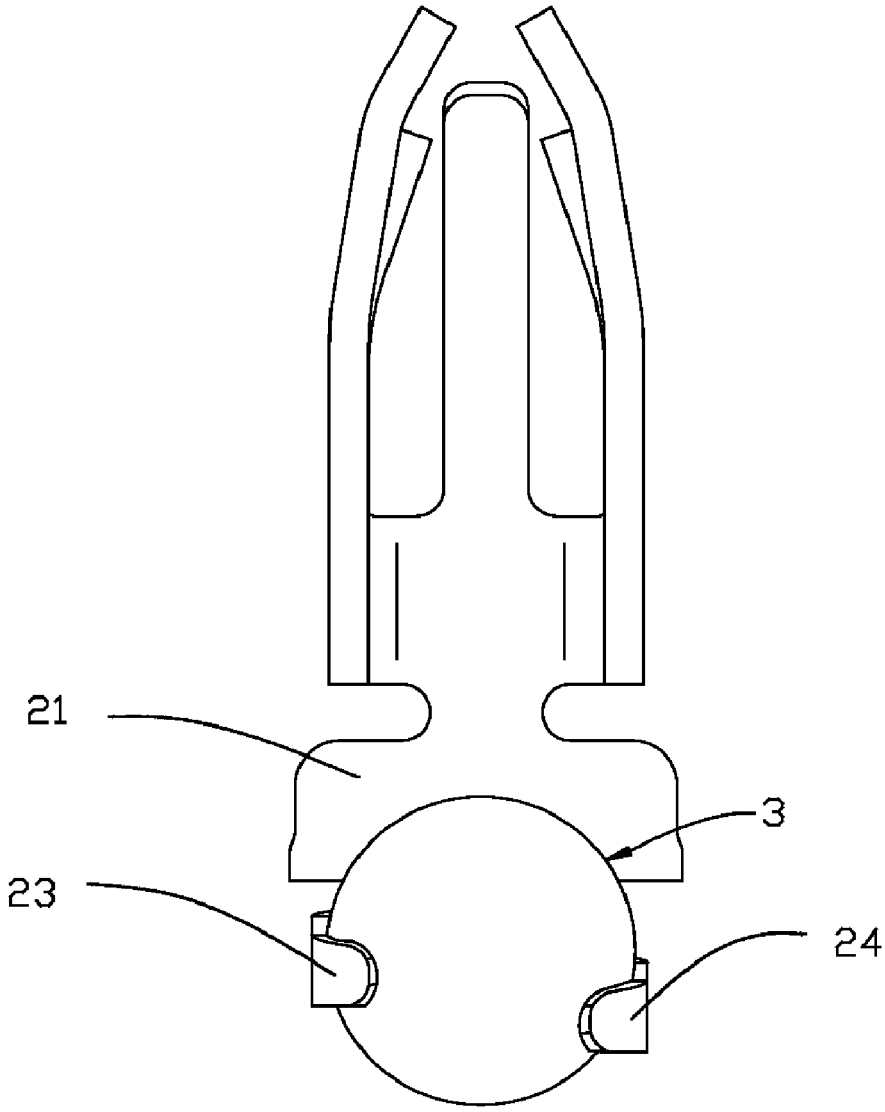
FIG. 6 is a front view of a terminal in another embodiment of the electrical connector according to the present invention.

Referring to FIG. 6, in other alternative embodiments, the second retaining portion 23 and the third retaining portion 24 may also stagger with each other in the vertical direction; and the contact points of the first retaining portion 22, the second retaining portion 23, and the third retaining portion 24 with the solder ball 3 are not in the same plane.

Accordingly, among other things, the electrical connector of the present invention has the following advantages.

1. The groove is formed on the first retaining portion. Before the groove is formed, the supporting points of the retaining forces of the second retaining portion and the third retaining portion to retain the solder ball are respectively at the junctions of the first retaining portion with the second retaining portion and the third retaining portion. However, after the groove is formed, the supporting points become the highest points of the groove, and the application points of the retaining forces of the second retaining portion and the third retaining portion to retain the solder ball are not changed and are still the contact points thereof with the solder ball. Evidently, after the groove is formed, the distance between the supporting points and the application points of the retaining forces of the second retaining portion and the third retaining portion to retain the solder ball becomes further, that is, the lengths of the arms of the retaining forces of the second retaining portion and the third retaining portion to retain the solder ball become longer, and thus the elasticity of the second retaining portion and the third retaining portion becomes better.

2. The solder ball abuts against the first retaining portion and has at least two contact points with the groove, and thus the number of the contact points of the solder ball with the terminal is increased, thereby not only increasing the contact area of the solder ball with the terminal so that the binding area of the terminal and the solder ball in the melting state during the soldering is increased, which reduces the contact resistance and enhances the stability of the soldering, but also newly adding the retaining force of the first retaining portion to the solder ball so that the stability of retaining the solder ball is improved.

3. When the highest point of the groove is located on the base, the distance between the supporting points and the application points of the retaining forces to retain the solder ball is the furthest, and the lengths of the arms of the retaining forces of the second retaining portion and the third retaining portion to retain the solder ball are the longest, and thus the elasticity of the second retaining portion and the third retaining portion to retain the solder ball is the most desirable and the soldering is the most reliable. Moreover, the terminal is fixed in the receiving slot through the interference fit between the base and the receiving slot, and when the magnitude of interference is large, the terminal has great deformation and requires a large plug-in/out force. However, when the highest point of the groove is located on the base, the breaking part appearing in the base is used as a retraction space for the base, so that the terminal has a small plug-in/out force and small deformation.

4. When the second retaining portion and the third retaining portion stagger with each other in the vertical direction, the contact points of the first retaining portion, the second retaining portion, and the third retaining portion with the solder ball are not in the same plane, that is, the retaining forces applied by the retaining portions to the solder ball are not in the same plane, and thus horizontal components and vertical components of the retaining forces are provided, so that the solder ball can be retained more stably.

5. The opposing surfaces of the second retaining portion and the third retaining portion are curved surfaces, and thus the contact points thereof with the solder ball are no longer one point, but at least two points, thereby not only increasing the contact area so that the binding area of the first retaining portion with the solder ball in the melting state during the soldering is increased, which reduces the contact resistance and enhances the stability of the soldering, but also increasing the retaining force of the first retaining portion to the solder ball so that the stability of retaining the solder ball is improved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a plurality of receiving slots running through the insulating body;

a plurality of terminals, wherein each of the terminals is correspondingly disposed in one of the receiving slots, and each of the terminals has a base, a first retaining portion formed by extending downwards the base, a second retaining portion and a third retaining portion formed by respectively extending and bending two side surfaces of the first retaining portion, a groove formed at one end of the first retaining portion away from the base, wherein one end of the groove away from the base is in an opening configuration, the groove runs through the first retaining portion from back to front, and a highest point of the groove is higher than a lowest point at junctions of the first retaining portion with the second retaining portion or the third retaining portion, and a retaining space formed together by the first retaining portion, the second retaining portion, and the third retaining portion; and a plurality of solder balls, wherein each of the solder balls is correspondingly disposed in one of the retaining spaces and abuts against the second retaining portion and the third retaining portion.

2. The electrical connector according to claim 1, wherein the groove is formed vertically upwards.

3. The electrical connector according to claim 1, wherein the groove is in an inverted U shape.

4. The electrical connector according to claim 1, wherein the highest point of the groove is located on the base.

5. The electrical connector according to claim 1, wherein the solder ball abuts against the first retaining portion and has at least two contact points with the groove.

6. The electrical connector according to claim 1, wherein opposing surfaces of the second retaining portion and the third retaining portion are curved surfaces.

7. The electrical connector according to claim 1, wherein the second retaining portion and the third retaining portion stagger with each other in the vertical direction.

8. The electrical connector according to claim 1, wherein free ends of the second retaining portion and the third retaining portion extend towards opposite directions.

* * * * *